United States Patent [19]

Karm

[11] 4,171,009

[45] Oct. 16, 1979

[54] FORMING FABRICS FOR PAPER-MAKING MACHINES AND METHODS OF MANUFACTURE THEREOF

[75] Inventor: Robert Karm, Selestat, France

[73] Assignee: Etablissements Martel, Catala & Cie S.A., Selestat, France

[21] Appl. No.: 780,249

[22] Filed: Mar. 22, 1977

[30] Foreign Application Priority Data

Apr. 2, 1976 [FR] France ..... 76 09744

[51] Int. Cl.[2] ..... D03D 15/00; D03D 15/02; B21F 1/10; B10D 39/08

[52] U.S. Cl. ..... 139/425 A; 139/413; 162/DIG. 1; 162/348

[58] Field of Search ..... 139/425 A, 425 R, 383 A, 139/408–413; 162/DIG. 1, 348, 349, 358; 245/8, 10, 2; 34/95

[56] References Cited

U.S. PATENT DOCUMENTS

| | | | |
|---|---|---|---|
| 3,127,308 | 3/1964 | Justus et al. | 139/425 A |
| 3,214,329 | 10/1965 | Wicker | 139/383 A |
| 3,858,623 | 1/1975 | Lefkowitz | 139/425 A |
| 3,885,602 | 5/1975 | Slaughter | 139/425 A |
| 3,915,202 | 10/1975 | Curtis et al. | 139/425 A |
| 4,041,989 | 8/1977 | Johansson et al. | 139/425 A |
| 4,112,982 | 9/1978 | Bugge et al. | 139/425 A |

FOREIGN PATENT DOCUMENTS

| | | | |
|---|---|---|---|
| 2517228 | 10/1976 | Fed. Rep. of Germany | 162/348 |
| 1415339 | 11/1975 | United Kingdom | 139/425 A |

*Primary Examiner*—James Kee Chi

[57] ABSTRACT

An endless forming fabric for paper-making machine comprises at least two layers of transverse threads and one layer of longitudinal threads. The upper loops formed by the longitudinal threads cover from three to seven transverse threads of the upper layer. The leading crossing points of these upper loops with the transverse threads are distributed in a weave pattern using at least five longitudinal threads. The weave pattern on the paper side of the fabric is selected so as to avoid alignment of the upper loops of adjacent threads and diagonal effects. The lower loops formed by the longitudinal threads, on the machine side of the fabric, pass each time only underneath a single transverse thread of the lower layer.

16 Claims, 9 Drawing Figures

FORMING FABRICS FOR PAPER-MAKING MACHINES AND METHODS OF MANUFACTURE THEREOF

BACKGROUND AND SUMMARY OF THE INVENTION

The present invention relates to forming fabrics for paper-making machines, this term being understood in its widest sense to include in particular machines for the manufacture of paper pulp, cellulose, Kraft paper, cardboard etc. It relates more particularly to endless multiply or multilayer forming fabrics having at least two plies or layers of transverse threads (i.e. threads running transversely to the direction of movement of the forming fabric in the paper-making machine) and one layer or ply of longitudinal threads (i.e. running in the direction of movement of the fabric during operation).

In a paper-making Fourdrinier machine the paper sheet is generally formed either on an endless forming fabric, or between two endless forming fabrics, or between an endless forming fabric and other members such as hollow fabric-covered cylinders or heated cylinders. The endless fabrics may be entirely of threads or yarns of synthetic or metal material or they may include, in combination, metal threads and mono- or multifilament synthetic threads. The multifilament synthetic threads are obtained by spinning out synthetic fibres or endless synthetic fibres; they may also be made by twisting such threads. The synthetic material is generally polyester or polyamide although other polymers or copolymers can be used. Before or during manufacture of the forming fabrics, the threads may be coated with a synthetic material.

The forming fabrics for paper-making machines must fulfil conditions which are to some extent contradictory.

The transverse rigidity of the forming fabric should be as high as possible, especially for fabrics of great length and width (respectively up to approx. 80 m and 10 m) which move at high speeds (e.g. 1100 m/min.). Insufficient transversal rigidity may result in the formation in the fabric of a fold which first deteriorates the sheet of paper formed on the fabric and ultimately ruins the fabric.

To increase rigidity, "double ply" fabrics have been used instead of single ply fabrics which have a single layer of longitudinal threads and a single layer of transverse threads. Such fabrics have two layers of transverse threads which both contribute to increase the transverse stiffness which is consequently much higher than in single ply fabrics.

For simplicity's sake, I shall call "upper layer" the layer of transverse threads located on the paper side when the fabric is on the paper-making machine. The lower layer of transverse threads will be the layer which, on the paper-making machine, is on the side of the fabric supporting members and dewatering elements (foils, suction boxes and the like).

It is well known that the fabric must impress on the material to be formed (typically a sheet of paper) a roughness or "mark" as faint as possible. Numerous attempts have been made to reduce the mark. Grinding the fabrics prior to use to make smoother the surface in contact with the paper has been proposed. But while the marks are less deep, they are wider. The number of threads per unit of surface has been increased to support the sheet of paper on a fabric having as many contact points as possible with the paper sheet but it results in a finer, therefore less resistant, fabric.

Up to now, it was generally felt that, in order to reduce the mark, it was advisable to increase the number of crossing points between longitudinal and transverse threads of the upper layer and to arrange that the outer surfaces of the undulations formed by all the threads towards the side of the sheet of paper are approximately tangential to a same plane. Such an assumption has led to use double layer fabrics wherein the longitudinal threads and the transverse threads of the upper layer are interwoven according to a "plain" weave at each crossing point, i.e. each longitudinal thread or yarn binds separately with one transversal thread or yarn of the upper layer at each crossing point.

Furthermore, the paper forming fabrics must have as high a resistance to abrasion as possible. In paper-making machines, the fabrics are supported on the inside by abrasive members, some of which support the fabric to keep it flat while others exert a suction on it to eliminate through the fabric a great part of the water in which the cellulose fibres and additives forming the paper pulp are in suspension.

The dewatering elements wear the fabric which must be replaced after a period of use. One of the principal concerns of manufacturers has been to increase the resistance to abrasion of the forming fabrics. For that purpose, attempts have been made to replace polyester yarns with polyamide yarns which are more resistant to abrasion. Unfortunately, the more abrasion resistant yarns are more flexible than the polyester yarns and it has been found that polyamide fabrics lack transverse stiffness and stretch too much under the tension necessary for use in paper-making machines.

In double ply fabrics, it has been suggested to increase the length of longitudinal threads in contact with the machine members causing abrasion by forming loops taking in several transverse threads at a time (U.K. Patent Specification No. 1,415,339 and U.S. Pat. No. 3,915,202).

This solution is only a palliative, for again the longitudinal threads are subjected to wear. As soon as the fabric is used, as wear increases, the tensile strength of the fabric diminishes. At a certain stage of wear, the fabric tears under the tensile forces to which the fabric is subjected during use in a paper-making machine.

It is a first object of the invention to provide an improved multilayer fabric for forming paper and the like which has a high transverse stiffness and at the same time does not impress an excessive mark on the paper.

It is another object to provide a multiply or multilayer forming fabric for a Fourdrinier machine which has a high resistance to wear by abrasion and consequently a long useful life.

An important step in conceiving the present invention was the determination of the surprising fact that the transverse threads mark the paper more than the longitudinal threads, even when the sheet of paper is supported by a fabric whose longitudinal and transverse threads have outer surfaces which are tangential to a same plane on the paper supporting side. That may be due to the anisotropy of the paper caused by the orientation given to the cellulose fibres during manufacture of the paper. Anyway, according to a first aspect of the invention, that finding is used by providing a multilayer fabric in which the threads are so interwoven that the outer loops formed by the longitudinal threads contacting the paper on the paper supporting side of the fabric, cover from three to seven transverse threads of the upper layer, the first crossing points of said outer loops and transverse threads being distributed according to a repeating weaving pattern comprising at least five longitudinal threads. The weaving pattern on the paper side of the fabric is additionally selected so as to avoid full alignment of said outer loops on adjacent threads and diagonal effects. The outer loops formed by the longitudinal threads on the machine side of the fabric pass each time only under a single transverse thread of the lower layer.

Preferably, the "filling coefficient" for the longitudinal threads (i.e. the cumulative width of the longitudinal threads—supposed to be side by side—per unit width of the fabric) is between 1.05 and 2.0.

By increasing the length of the loops of the longitudinal threads in contact with the sheet of paper, contact of the transverse threads with the sheet of paper is avoided. Alignment of loops in a particular direction and diagonal effects are avoided by not using, for the upper loops, the patterns which are called semitwill and twill in the textile industry. The "beginnings" of the loops (the beginning being the location where the longitudinal thread forming the loop crosses with the first transverse thread which it binds) are typically distributed in the upper layer in the form of a regular or irregular satin weave using five or more longitudinal threads.

The fabric typically has two layers of transverse threads and a layer of longitudinal threads all of synthetic material, is flat woven and junctioned to make it endless. The upper loops formed by the longitudinal threads (warp threads) of synthetic material on the paper receiving side of the fabric cover from three to seven transverse threads (generally three or four transverse threads) of the upper layer. The first crossing points of the loops with the transverse threads may be distributed according to a satin weave of at least five threads. The lower loops formed by the longitudinal threads on the machine side of the fabric pass each time only under one transverse thread of the lower layer.

Advantageously, the transverse threads of the lower layer may have different characteristics from those of threads used for the other layer(s) of transverse threads and may have a higher resistance to abrasion. The transverse threads of at least one of the layers can have a diameter greater than that of the longitudinal threads, the ratio between the diameters being then advantageously equal to 1.05 at least and 2.5 at most, different threads may be used (for instance alternate polyester and polyamide threads).

The forming fabric is advantageously woven, or treated after weaving (e.g. subjected to a fixing heat treatment while maintained under longitudinal tension) under such conditions that, when the fabric is new, only transverse threads are in contact with the fabric supporting members of the machine.

In particular embodiments, each longitudinal thread forms either one lower loop, i.e. a separate binding with a thread of lower layer, or two successive such lower loops between two successive upper loops, i.e. two successive loops over transverse threads of the upper layer. Then, the transverse threads withstand abrasion until their thickness has substantially decreased due to wear out. During this phase, the resistance of the fabric to longitudinal tension does not substantially decrease.

The invention will be better understood from the following description of particular embodiments given by way of non limiting examples.

SHORT DESCRIPTION OF THE DRAWINGS

Figure 1:
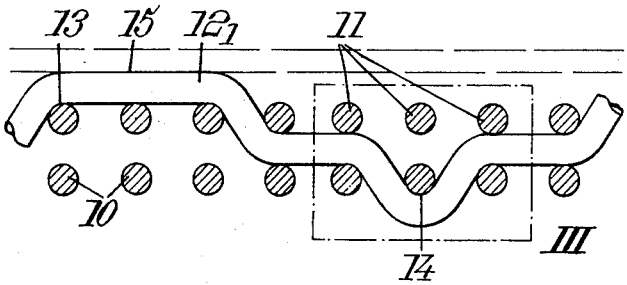
FIG. 1 is a diagrammatic cross section along line I—I of FIG. 2 of a portion of a first fabric according to the invention.
Figure 2:
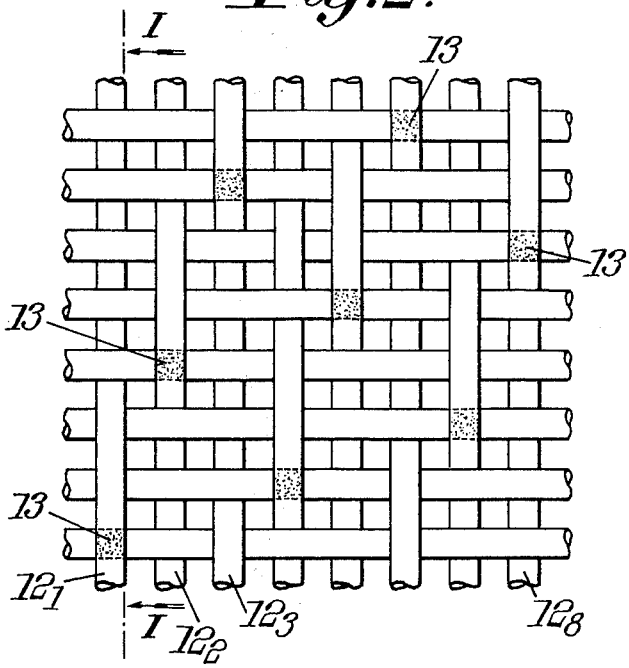
FIG. 2 is a diagram showing the weaving pattern of the fabric of FIG. 1 as seen from the paper side (upper layer)
Figure 4:
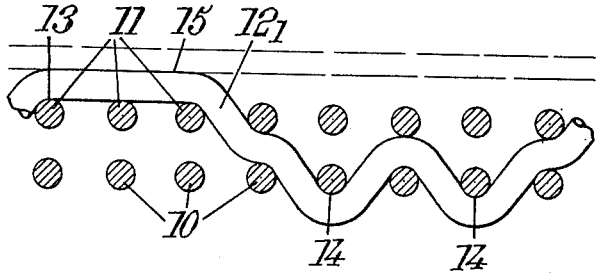
Figure 5:
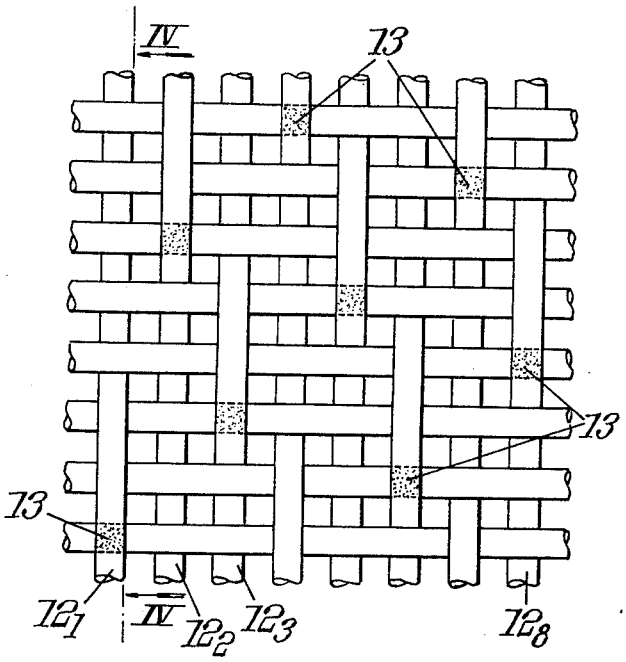
Figure 6:
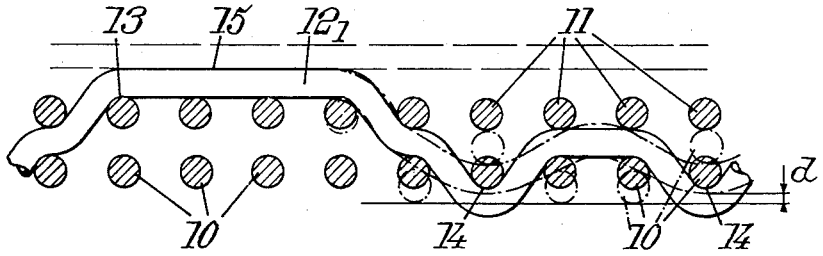
Figure 7:
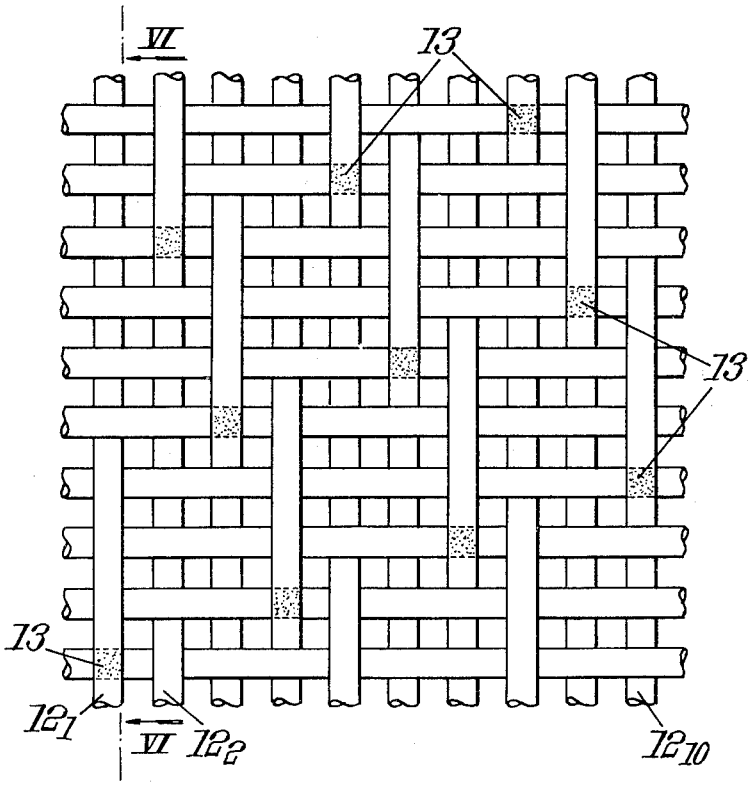

FIGS. 4 and 5, respectively similar to FIGS. 1 and 2, illustrate another embodiment;

FIGS. 6 and 7, also similar to FIGS. 1 and 2, illustrate yet another embodiment.

Figure 8:
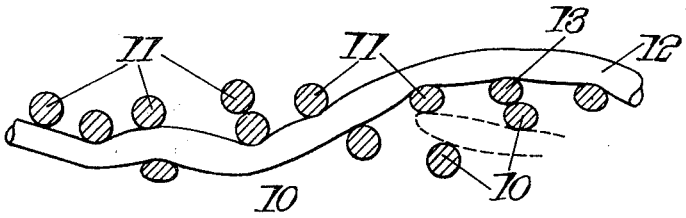
Figure 9:
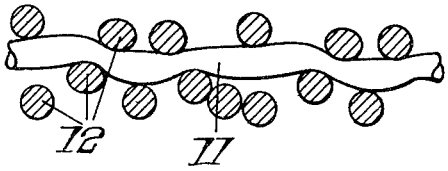

FIGS. 8 and 9 are cross-sectional views along a longitudinal thread and along a transversal or cross-machine thread of the upper layer, respectively, of an actual double ply fabric according to the embodiment of FIGS. 4–5.

DETAILED DESCRIPTION OF PREFERRED EMBODIMENTS

As indicated above, the fabrics are typically woven so that the filling coefficient for the longitudinal threads is 1.05 or more, typically 1.2. However, for more clarity, the diagrams of the drawings correspond to filling coefficients which are much smaller and in addition the threads are represented at even intervals rather than in their actual respective locations.

Taking into account the high value of the filling coefficient, it will be appreciated that the sheet of paper is essentially supported by long loops of the longitudinal threads, which do not exhibit abrupt curvatures or "knees" at the crossing points with the cross machine threads. The mark impressed on the sheet of paper is thereby considerably diminished.

The surface of the illustrated fabrics which is in contact with the dewatering elements of the machine is designed to increase the useful life. Contrary to the usual technique which consists in forming, on the machine side, loops of the longitudinal threads passing under at least two transverse threads of the lower layer (U.K. Patent Specification No. 1,415,339), each loop binds with a single transverse thread at each crossing.

Referring to FIGS. 1 and 2, there is shown a fragment of a fabric which has a lower layer of transverse threads 10 and an upper layer of transverse or cross-machine threads 11 connected by longitudinal threads $\mathbf{12}_1$, $\mathbf{12}_2$, . . . $\mathbf{12}_8$. Assuming that the fabric has been flat woven and then junctioned by splicing the ends, the longitudinal threads are formed by warp threads and the transverse threads by weft threads.

Each longitudinal thread 12 passes successively, from a crossing point 13 at which it passes from under to above the upper layer of threads 11, over three transverse threads 11, then between two threads 11 and the two associate threads 10 of the lower layer, then under one transverse thread 10 of the lower layer with which it has a plain binding, then between two threads 11 and the two corresponding threads 10; the pattern then is repeated.

As shown on FIG. 2, the points 13 are distributed according to an eight thread satin weaving pattern with a shift of three between two successive longitudinal threads.

Each loop 15 over the upper layer binds three threads 11. Each loop 14 of a longitudinal thread below the lower layer binds with or passes under a single thread 10 of this layer. Due to this arrangement and taking into account the tension exerted on the warp threads during weaving and/or finishing treatments, the longitudinal thread 12 forces the bindings with the transverse threads of the lower layer 10 to locations 14 as shown on FIG. 3 rather than as shown on FIG. 1. Thus transverse threads 10 remain on the surface of the fabric, on the machine side and, at locations 14, the longitudinal threads are "buried" in the fabric and they are tangent to a plane deeper in the fabric than the plane tangent to the outer surfaces of the cross machine threads 10. This is apparent on FIG. 3 where the surface of the longitudinal thread at point 14 is offset relative to the transverse threads 10 by a distance d which may be equal to approx. half the diameter of transverse threads 10.

As a consequence, the lower surface of the fabric is principally covered by transverse threads 10 which withstand the abrasion caused by the machine elements. The wear of the fabric affect the longitudinal threads 12 only after wear out from the transverse threads 10 of material corresponding to distance d. The fabric has then the advantage that the wear does not affect the tensile strength of the fabric before the transverse threads have worn to a considerable amount.

It may be noted at this stage that the possibility of "burying" the longitudinal warp threads by tensioning them for delaying wear thereof has been recognized for long in single layer fabrics and is known as "weft effect". However, that result is much more easily obtained in a double layer fabric according to the invention since the longitudinal threads take a strong support on the groups of cross-machine threads of the upper layer with which it binds (groups of three threads in FIGS. 1–5, groups of four threads in FIGS. 6–7).

Due to the inherent transverse rigidity of multiply fabrics, a thread selected taking into account other requirements can be used for one of the layers. This thread can have characteristics different from those of the threads of the other layers without loss of the transverse stiffness necessary for proper operation in a paper-making machine. The different characteristics can be chemical composition, resistance to abrasion, stiffness, tensile strength, resilient yield, etc.

A fabric can be made for example having lower layer transverse threads 10 with a better resistance to abrasion than the other threads 11 and 12; this fabric, whose transverse threads of lower layer 10 will withstand abrasion, will last longer. Among the special threads having a better abrasion resistance than polyester monofilament threads used currently in the manufacture of forming fabrics, are polyamide monofilaments, different types of coated multifilaments, and threads coated with a resin highly resistant to abrasion, such as certain polyurethanes. Special threads having a low stiffness can be accepted, up to the point that if the special threads were used for manufacturing the whole fabric, the fabric would be unusable in a paper-making machine due to lack of transverse stiffness.

The fact that the longitudinal threads are practically alone in supporting the sheet of paper results in further advantages. The diameter of the transverse threads may be increased without affecting the mark impressed in the paper. The result is a possible increase in the transverse stiffness of the fabrics as well as a longer life since the transverse threads of the lower layer initially withstand the wear.

Figure 3:
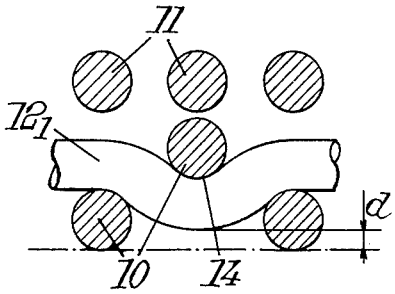
FIG. 3 shows on an enlarged scale the arrangement of the threads following tensioning of the longitudinal threads.

Referring now to FIGS. 4 and 5 (where the same reference numerals as in FIGS. 1–3 are used to designate corresponding parts) there is shown a fabric which differs from that of FIGS. 1–3 in that:

instead of forming a single loop 14, the threads 12 form two successive loops, each below a single transverse thread 10 of the lower layer, points 13 (shown by dotted line squares in FIG. 5) are distributed according to a satin weaving pattern of eight longitudinal threads with a shift of five.

Referring now to FIGS. 8 and 9, it appears that the material to be formed is essentially supported by long loops of the longitudinal wires and there are no zones of abrupt curvatures or acute knuckles in contact with the material. The longitudinal threads exhibit gentle ondulations over the cross-machine threads of the upper layer. Due to the high value of the filling ratio, the material to be formed is supported by the longitudinal threads at points which are close to each other.

Referring last to FIGS. 6 and 7, there is shown a fabric in which:

loop 15 passes over four transverse threads of the upper layer 11, instead of forming a single loop 14, each thread 12 passes successively twice under a respective transverse thread 10 of the lower layer, thread 12 passing, between two successive loops, over two threads 10 of that same lower layer, points 13 are distributed according to a satin weave of ten longitudinal threads with a shaft of three.

Tensioning of longitudinal threads 12 which occurs during weaving if the fabric is flat woven and may be complemented off loom during a finishing treatment, which will be the case most often, or which occurs during later heat treatment for fixing, tends to straighten them from the position shown with a continuous line to the broken line position (FIG. 6). Following this deformation, the lower loops 14 are buried in the thickness of the fabric, so that the latter will bear on the supporting and suction members of the machine (not shown) essentially by the transverse threads 10.

The film of material to be formed (such as paper pulp) shown schematically with dashed lines in FIGS. 1, 4 and 6, is essentially supported by loops 15 formed by the longitudinal threads, which will result in a faint mark.

It will be appreciated that the types of satin weave patterns shown schematically in FIGS. 2, 5 and 7 are not only the patterns which can be used in combination with the types of weaving illustrated in FIGS. 1, 4 and 6. Other regular or irregular satin weave patterns, as well as other patterns, can be used.

All the fabrics described can, particularly when they are formed entirely from synthetic fibres, be woven on existing heavy looms. The loom should be provided with two warp beams when the threads of the two layers are not identical and the fabric is circular woven. For fabrics which are flat woven and then spliced (the longitudinal threads corresponding to warp threads and the transverse threads to weft threads), the loom must be provided with means for insertion of two types of weft thread to attain the same result.

I claim:

1. Endless forming fabric for paper-making machine and the like, comprising:

an upper layer of threads transverse to the direction of movement of the fabric on the machine and located on the material forming side of the fabric, a lower layer of threads transverse to said direction of movement and located on the wear side of the fabric, and longitudinal threads interwoven with the layers of transverse threads, wherein all loops formed by the longitudinal threads over the transverse threads of the upper layer bind with from 3 to 7 transverse threads of the upper layer and the first points of crossing of such loops with the transverse threads are distributed according to a weaving pattern comprising at least five longitudinal threads, and the weaving pattern on the outer surface of the fabric which supports the material to be formed is of a type without alignments of said loops on adjacent threads and without diagonal effects, and wherein the longitudinal threads form loops each binding with one transverse thread of the lower layer on the wear side of the fabric.

2. Endless fabric according to claim 1, wherein the longitudinal and transverse threads are selected from the group consisting of synthetic multifilament threads and synthetic monofilament threads.

3. A fabric according to claim 1, wherein one at least of the layers has threads of different types distributed according to a repeating sequence.

4. Endless forming fabric for paper-making machine and the like, comprising:

an upper layer of snythetic threads transverse to the direction of movement of the fabric on the machine and located on the material forming side of the fabric, a lower layer of synthetic threads transverse to said direction and located on the wear side of the fabric, and synthetic longitudinal threads interwoven with the layers of transverse threads, wherein:

the longitudinal threads form loops whose outer surface constitute the paper forming surface over the threads of said upper layer, each side loop covering from three to seven threads of the upper layer, the first points of crossing of said loops with the upper layer are distributed according to a satin weave pattern of at least five threads in either direction, and the longitudinal threads form loops under the lower layer, said last named loops each binding with one transverse thread only of the lower layer.

5. A fabric according to claim 4, wherein the transverse threads of the lower layer have characteristics which are different from those of the threads of the other layer of transverse threads.

6. A fabric according to claim 5, wherein the transverse threads of the lower layer have a resistance to abrasion which is greater than that of the threads of the upper layer and of the longitudinal threads.

7. A fabric according to claim 4, wherein the transverse threads of one at least of said upper and lower layers have a diameter greater than that of the longitudinal threads.

8. A fabric according to claim 7, wherein the ratio between the diameter of the transverse threads of said one layer and the diameter of the longitudinal threads is between 1.05 and 2.5.

9. A fabric according to claim 8, wherein the ratio is approximately 1.2.

10. A fabric according to claim 4, wherein the first crossing points of the loops of the longitudinal threads over the transverse threads of the upper layer are distributed according to a satin weave pattern comprising at least six longitudinal threads.

11. A fabric according to claim 4, wherein each longitudinal thread forms one loop under a transverse thread of the lower layer between two successive upper loops over threads of the upper layer.

12. A fabric according to claim 1, wherein the longitudinal threads are inwardly offset with respect to the plane tangent to the outer surfaces of the transverse threads of said lower layer.

13. A fabric according to claim 1, wherein the filling coefficient of the longitudinal threads is at least 1.05.

14. A fabric according to claim 13, wherein said filling coefficient is of from 1.2 to 2.0.

15. A fabric according to claim 4, wherein the filling coefficient of the longitudinal threads is of from 1.2 to 2.0.

16. Endless forming fabric for a paper-making machine and the like, comprising:

an upper layer of synthetic weft threads transverse to the direction of movement of the fabric on the machine and located on the material forming side of the fabric, a lower layer of synthetic weft threads transverse to said direction and located on the wear side of the fabric, and synthetic longitudinal threads interwoven with both layers of transverse threads, the filling coefficient of said longitudinal threads being at least equal to 1.05, wherein the longitudinal threads form top loops which cover from three to seven transversal threads of the upper layer and said top loops are distributed according to a satin weave pattern comprising at least six longitudinal threads, wherein each longitudinal thread forms bottom loops each under one of the threads of the lower layer, and the outer surface of each said bottom loop is located inwardly of the plane tangent to the outer surfaces of the transverse threads of said lower layer.

* * * * *